US007047658B2

(12) United States Patent
Danielli et al.

(10) Patent No.: US 7,047,658 B2
(45) Date of Patent: May 23, 2006

(54) APPARATUS AND METHOD TO MEASURE THE DIMENSIONAL AND FORM DEVIATION OF CRANKPINS AT THE PLACE OF GRINDING

(75) Inventors: Franco Danielli, Zola Predosa (IT); Carlo Dall'Aglio, Castello D'Argile (IT)

(73) Assignee: Marposs Societa per Azioni, Bentivoglio (IT)

( * ) Notice: Subject to any disclaimer, the term of this patent is extended or adjusted under 35 U.S.C. 154(b) by 267 days.

(21) Appl. No.: 10/220,320

(22) PCT Filed: Jan. 19, 2001

(86) PCT No.: PCT/EP01/00596

§ 371 (c)(1),
(2), (4) Date: Aug. 29, 2002

(87) PCT Pub. No.: WO01/66306

PCT Pub. Date: Sep. 13, 2001

(65) Prior Publication Data

US 2003/0056386 A1 Mar. 27, 2003

(30) Foreign Application Priority Data

Mar. 6, 2000 (IT) ..... BO2000A0112

(51) Int. Cl.
*G01B 3/00* (2006.01)

(52) U.S. Cl. ..... 33/555.1; 33/555.3; 33/702

(58) Field of Classification Search ..... 33/555, 33/555.1, 555.3, 549–550, 702, 706
See application file for complete search history.

(56) References Cited

U.S. PATENT DOCUMENTS 4,437,239 A * 3/1984 Possati ..... 33/501.02
4,480,412 A * 11/1984 Shank et al. ..... 33/501.04
4,903,413 A * 2/1990 Bellwood ..... 33/551
5,077,908 A * 1/1992 Moore ..... 33/550
5,337,485 A * 8/1994 Chien ..... 33/550
6,067,721 A * 5/2000 Dall'Aglio et al. ..... 33/555.1
6,298,571 B1 * 10/2001 Dall'Aglio et al. ..... 33/555.1
6,430,832 B1 * 8/2002 Dall'Aglio et al. ..... 33/555.1
6,568,096 B1 * 5/2003 Svitkin et al. ..... 33/550
6,931,749 B1 * 8/2005 Dall'Aglio ..... 33/555.3

(Continued)

FOREIGN PATENT DOCUMENTS

EP 1 063 052 A2 12/2000

(Continued)

*Primary Examiner*—Yaritza Guadalupe
(74) *Attorney, Agent, or Firm*—Dickstein Shapiro; Morin & Oshinsky LLP

(57) ABSTRACT

An apparatus and a relevant method for checking a crankpin (18) of a crankshaft (34) positioned on a numerical control grinding machine where it is worked includes a gauging head (39) with a Vee-shaped reference device (20) and a feeler (17), axially movable along a translation direction, that touches the crankpin surface, and an articulated support device (5,9,12) connected to the grinding-wheel slide (1), carrying the guaging head and allowing the reference device (20) to keep contact with the crankpin during its orbital motion around the main rotation axis (0) of the crankshaft. Rough values corresponding to a transducer (41) signals provided at predetermined angular positions of the crankshaft are stored and are processed also to compensate alterations caused both by contact between the sides of the Vee-shaped reference device and the surface of the crankpin to be checked, and by variations of the angular arrangement of the Vee-shaped reference device in the course of orbital rotations of the pin.

22 Claims, 7 Drawing Sheets

U.S. PATENT DOCUMENTS

| | | | | |
|---|---|---|---|---|
| 2002/0020075 | A1* | 2/2002 | Dall'Aglio et al. | 33/555.1 |
| 2002/0066197 | A1* | 6/2002 | Sano et al. | 33/549 |
| 2002/0155790 | A1* | 10/2002 | Ido et al. | 451/9 |
| 2002/0166252 | A1* | 11/2002 | Dall'Aglio et al. | 33/555.3 |
| 2003/0009895 | A1* | 1/2003 | Dall'Aglio et al. | 33/555.3 |

FOREIGN PATENT DOCUMENTS

| | | | |
|---|---|---|---|
| WO | WO 97/12724 | | 4/1997 |
| WO | WO 97/40434 | | 10/1997 |
| WO | WO9947884 | * | 9/1999 |

* cited by examiner

APPARATUS AND METHOD TO MEASURE THE DIMENSIONAL AND FORM DEVIATION OF CRANKPINS AT THE PLACE OF GRINDING

TECHNICAL FIELD

The present invention refers to an apparatus for the dimensional and form deviation checking of a crankpin of a crankshaft during orbital rotations about a main rotation axis on a numerical control grinding machine where it is worked, the grinding machine having a grinding-wheel slide carrying a grinding wheel and a worktable defining said main rotation axis, with a gauging head with a Vee-shaped reference device adapted to engage the crankpin to be checked, a feeler adapted to touch the surface of the crankpin to be checked, and a transducer adapted to provide signals indicative of the position of the feeler with respect to the Vee-shaped reference device, a support device, with mutually movable coupling elements, that movably supports the gauging head, a control device to control automatic displacements of the gauging head from a rest position to a checking position, and vice-versa, and processing and display devices connected to the gauging head adapted to receive and process said signals provided by the transducer.

The invention refers also to a method for checking the form deviation of a pin defining a geometrical symmetry axis, the pin orbitally moving about a main rotation axis parallel to and spaced apart from the symmetry axis.

BACKGROUND ART

Apparatuses having the above-mentioned features are shown in international patent application published with No. WO-A-9712724.

The embodiments described in such international application guarantee excellent metrological results and small forces of inertia and the standards of performance of the apparatuses with these characteristics, manufactured by the company applying for the present patent application, confirm the remarkable quality and the reliability of the applications.

In many numerical control grinding machines presently produced for working crankshafts, each piece to be worked is positioned on the worktable and rotated about its main rotation axis (i.e. the axis defined by the journal bearings), and during the rotation both journal bearings and crankpins are ground. As far as the crankpins are concerned, the proper working requires extremely accurate translation movements between the grinding-wheel slide and the worktable, synchronously with rotational movements of the shaft, under the control of the numerical control (NC) of the machine based on a proper working program that is the result of a numerical interpolation. Unavoidable imperfections in the dimensions or form deviation of the mechanical parts of the machine cause circularity or roundness deviations in the cylindrical surface of the ground workpiece. In order to correct such deviations (and considering that 2–3 μm is a typical value of tolerance for this kind of deviations, as required for crankshafts to be employed in cars), roundness of the worked crankpins must be checked, and the working program of the CN must be consequently corrected. Checking of the roundness of the crankpins is presently carried out by means of proper metrological apparatuses including a revolving table performing greatly accurate rotation movements, where the crankshaft is referred and fixed in such a way that the crankpin to be checked is substantially centred with respect to the rotation axis. A gauge having radial measuring axis detects the variations in correspondence of at least a transversal cross-section of the pin surface that is scanned in the course of a 360° rotation of the revolving table, with a proper sampling frequency. The detected variation values are processed to get the best-fit circumference, i.e. the circumference that best approximates the locus of the points corresponding to such values. Deviations of the detected values with respect to values of the best-fit circumference are calculated to define the roundness error of the checked surface, according to a well-known technique.

According to the presently used procedure, in order to check the roundness it is necessary to have a specific, costly and bulky apparatus, and to sequentially perform the following operations: remove the crankshaft to be checked from the grinding machine where it has been ground, position the crankshaft on the specific apparatus where careful operations are needed for a proper positioning and fixing on the revolving table, carry out the checking process, analyse the results, and manually correct the grinding program of the CN on the basis of such results. As a consequence, the involvement of properly instructed operators is needed to carry out the checking and the correction. Moreover, performing the above-mentioned operations negatively affects the working process, requiring not negligible interruptions, and appears in contrast with the even increasing requirements to continuously and timely check the production process.

DISCLOSURE OF THE INVENTION

An object of the present invention is to obtain a checking apparatus and a checking method allowing to carry out accurate and timely roundness or circularity checking of crankpins with the crankshaft still positioned on the grinding machine where it is worked.

Another object of the present invention is to obtain a checking apparatus and a checking method allowing to check both diametral dimensions of a crankpin that is orbitally rotating during its working on a grinding machine, and the roundness of the ground crankpin, during an additional orbital motion of the crankpin in the grinding machine.

These and other objects and advantages are obtained by means of a checking apparatus and a checking method according to, respectively, claims 1 and 13.

BRIEF DESCRIPTION OF THE DRAWINGS

The invention is now described in more detail with reference to the enclosed drawings, showing preferred embodiments by way of illustration and not of limitation. In said drawings.

BEST MODE FOR CARRYING OUT THE INVENTION

Figure 1:
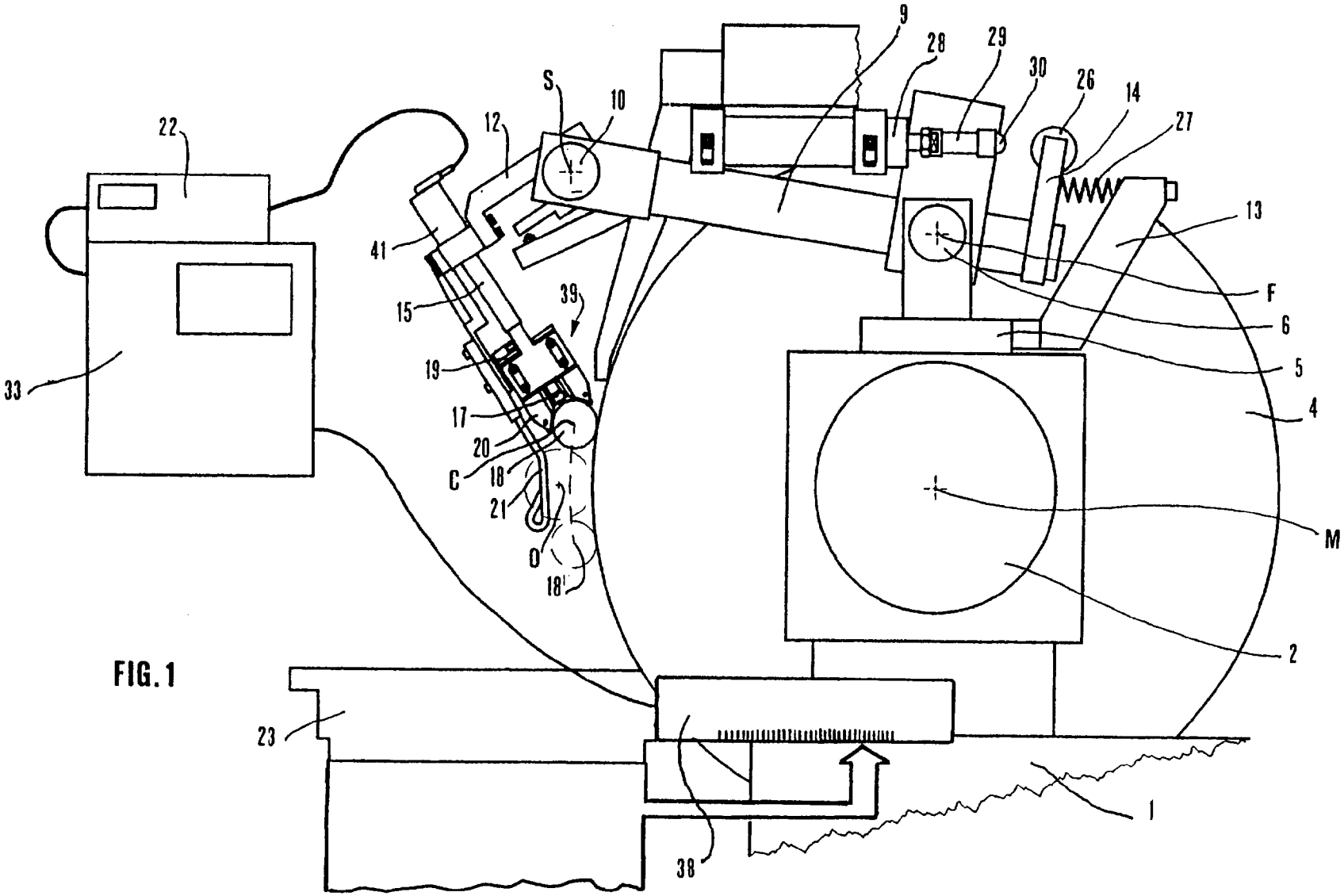
FIG. 1 is a lateral view of a measuring apparatus mounted on the grinding-wheel slide of a grinding machine for crankshafts, shown in an operating condition during the checking of a crankshaft being ground.
Figure 2:
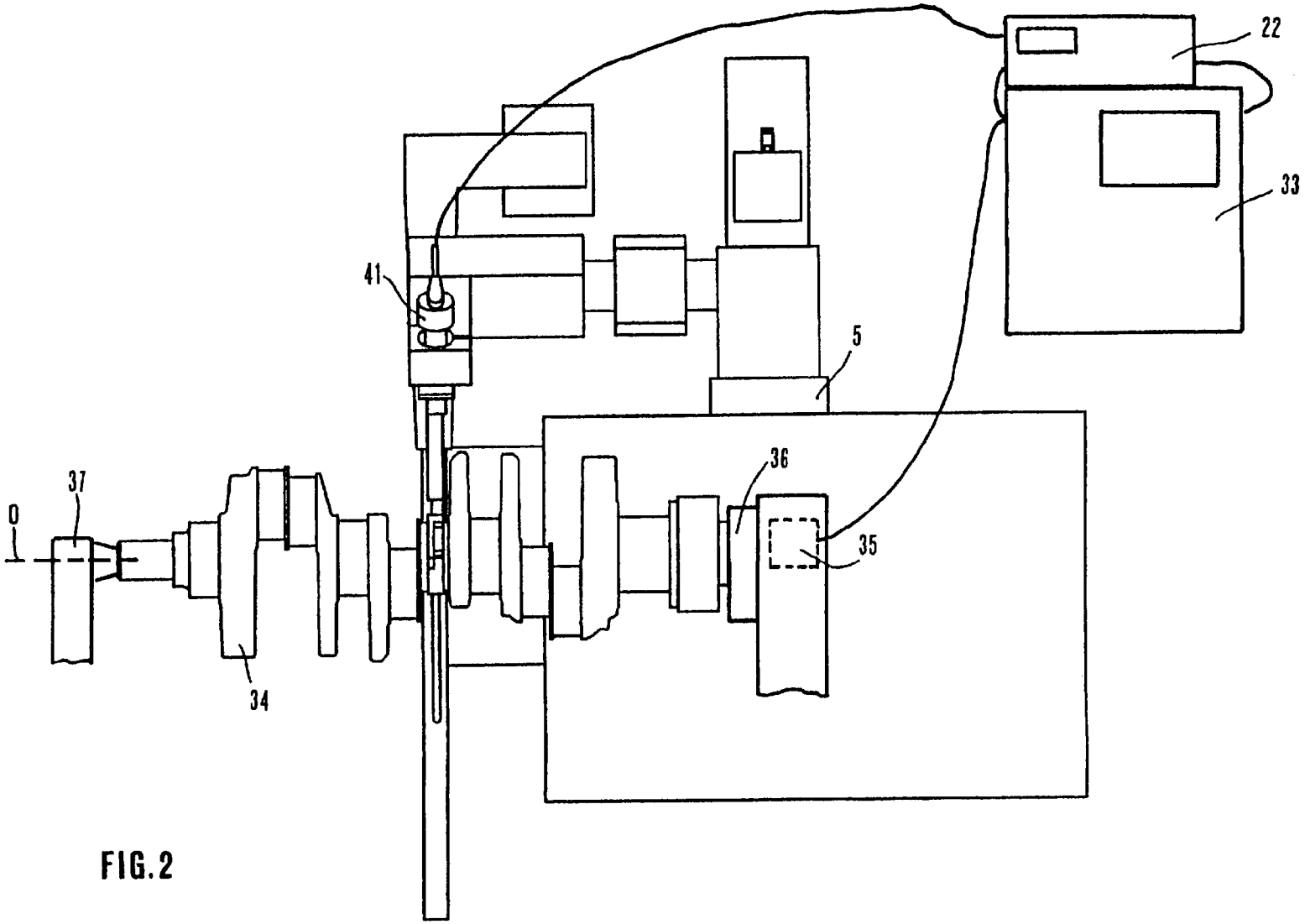
FIG. 2 is a front view of the apparatus of FIG. 1 mounted on the grinding-wheel slide of the grinding machine.

With reference to FIGS. 1 and 2, the grinding-wheel slide 1 of a computer numerical control ("CNC") grinding machine for grinding crankshafts 34 supports a spindle 2 that defines the rotation axis M of grinding wheel 4. The grinding-wheel slide 1 carries—above spindle 2—a support device of a checking apparatus, including a support element 5 and a first (9) and a second (12) rotating coupling elements. The support element 5, by means of a rotation pin 6, supports the first rotating coupling element 9. Pin 6 defines a first axis of rotation F parallel to the rotation axis M of grinding wheel 4 and to the main rotation axis O of the crankshaft 34. In turn, coupling element 9—by means of a rotation pin 10 defining a second axis of rotation S parallel to the rotation axes M and O—supports the second coupling element 12. At the free end of coupling element 12 there is coupled a guide casing 15 wherein there can axially translate a transmission rod 16 (FIG. 3) carrying a feeler 17 for contacting the surface of a pin 18 to be checked, in particular a crankpin of crankshaft 34, as FIG. 1 shows. The geometrical symmetry axis of crankpin 18 being worked is indicated in the figures with reference C. Guide casing 15, transmission rod 16 and feeler 17 are components of a gauging or measuring head 39 that includes a support block 19, too. The support block 19 is fixed at the lower end of the guide casing 15 and supports a reference device 20, Vee-shaped, adapted for engaging the surface of crankpin 18 to be checked, by virtue of the rotations allowed by pins 6 and 10. The transmission rod 16 is movable along the bisecting line of the Vee-shaped reference device 20.

The support block 19 further supports a guide device 21, that, according to the description of the above-mentioned international patent application published with No. WOA-9712724, serves to guide the reference device 20 to engage crankpin 18 and maintain contact with the crankpin 18 while the reference device 20 moves away from the crankpin, for limiting the rotation of the first 9 and of the second 12 coupling elements about the axes of rotation F, S defined by pins 6 and 10.

Figure 3:
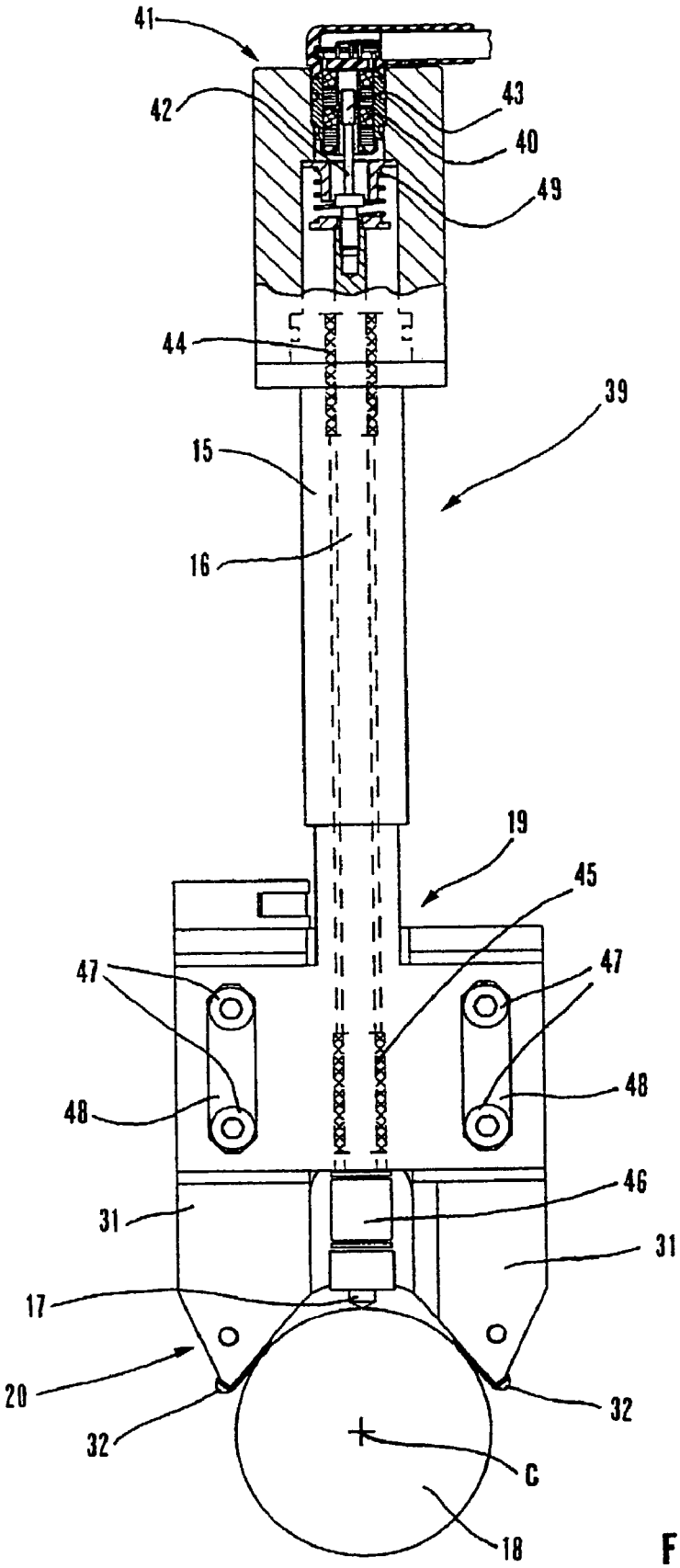
FIG. 3 is a partially cross-sectioned view of the measuring device of the apparatus of FIGS. 1 and 2.

The axial displacements of transmission rod 16 with respect to a reference position are detected by means of a measurement transducer, fixed to tubular casing 15, for example a transducer 41 of the LVDT or HBT type (known per se), with fixed windings 40 and a ferromagnetic core 43 coupled to a movable element, or rod 42, movable with the transmission rod 16 (FIG. 3). The axial displacement of the transmission rod 16 is guided by two bushings 44 and 45, arranged between casing 15 and rod 16, and a compression spring 49 pushes rod 16 and feeler 17 towards the surface of the crankpin 18 to be checked or towards internal abutting surfaces (not shown in the figures) defining a rest position of the feeler 17. A metal bellows 46, that is stiff with respect to torsional forces and has its ends fixed to rod 16 and to casing 15 (or to support block 19), respectively, accomplishes the dual function of preventing rod 16 from rotating with respect to casing 15 (thus preventing feeler 17 from undertaking improper positions) and sealing the lower end of casing 15.

The support block 19 is secured to guide casing 15 by means of pairs of screws 47 passing through slots 48 and supports reference device 20, consisting of two elements 31 with sloping surfaces, whereto there are secured two bars 32. The rest position of feeler 17 can be adjusted by means of screws 47 and slots 48. Transducer 41 of head 39 is connected to a processing and display device 22, the latter being on its turn connected to the numerical control (NC) 33 of the grinding machine.

The coupling elements 9 and 12 are basically linear arms with geometric axes lying in transversal planes with respect to the rotation axis O of the crankshaft and to the rotation axis M of grinding wheel 4. However, as schematically shown in FIG. 2, in order to avoid any interferences with elements and devices of the grinding machine, the coupling elements 9 and 12 comprise portions extending in a longitudinal direction and portions offset in different transversal planes.

A control device includes a double-acting cylinder 28, for example of the hydraulic type. Cylinder 28 is supported by grinding-wheel slide 1 and comprises a movable element, in particular a rod 29, coupled to the piston of cylinder 28, carrying at the free end a cap 30. An arm 14 is fixed at an end to element 9 and carries, at the other end, an abutment with an idle wheel 26. When cylinder 28 is activated for displacing the piston and the rod 29 towards the right (with reference to FIG. 1), cap 30 contacts the idle wheel 26 and causes the displacement of the checking apparatus to a rest position according to which reference device 20 is set apart from the surface of the crankpin. An overhang 13 is rigidly fixed to the support element 5 and a coil return spring 27 is joined to the overhang 13 and the arm 14.

When, in order to permit displacement of the apparatus to the checking condition, rod 29 is retracted, and cap 30 disengages from the abutment, or idle wheel 26, support block 19 approaches the crankpin 18 through rotation of the coupling elements 9, 12, and the apparatus reaches and keeps the checking condition, substantially as described in detail in the above-mentioned international patent application published with No. WO-A-9712724.

The cooperation between crankpin 18 and reference device 20 is maintained thanks to the displacements of the components caused by the force of gravity. The action of the coil spring 27, the stretching of which increases with the lowering of the support block 19, partially and dynamically counterbalances the forces due to the inertia of the moving parts of the checking apparatus following the displacements of the crankpin 18. In such a way, it is possible, for example, to avoid over stresses between the reference device 20 and the crankpin 18, in correspondence of the lower position (shown in FIG. 1 with reference number 18'), that might tend to cause deformations of the Vee shape of the reference device 20. On the other side, since during the raising movement of the apparatus (due to rotation of the crankpin towards the upper position where crankpin 18 is shown in FIG. 1), the pulling action of the spring 27 decreases, the inertial forces tending, in correspondence of the upper position, to release the engagement between the Vee reference device 20 and the crankpin 18, can be properly counterbalanced. In the latter case, it is pointed out that the counterbalancing action is obtained, by means of the spring 27, through a decreasing of its pulling action. In other words, the coil spring 27 does not cause any pressure between the reference device 20 and the crankpin 18, that mutually cooperate, as above mentioned, just owing to the force of gravity.

The crankshaft 34 to be checked is positioned on the worktable 23, between a driving device with a spindle 36 and a tailstock 37, schematically shown in FIG. 2, that define the main rotation axis O, coincident with the main geometrical axis of the crankshaft. As a consequence, crankpin 18 performs an orbital motion about axis O. An angular detection unit has a rotative transducer, schematically shown in FIG. 2 with reference number 35, e.g. including a diffraction grating interferometer. The rotative transducer 35 detects angular positions θ of the crankshaft 34 and is connected to the NC 33 of the grinding machine and, through the NC 33, to the processing and display device 22. A linear transducer for detecting mutual translation movements between the grinding-wheel slide 1 and the worktable 23 is schematically shown in FIG. 1 with reference number 38, and is connected to the NC 33 of the grinding machine. The signals outputted by the rotative (35) and linear (38) transducers are used by the NC 33 to properly control the movements of parts of the machine during the grinding of the crankpin 18.

During the checking phase, the transducer 41 of the gauging head 39 sends to the processing and display device 22 signals the values of which are indicative of the position of the feeler 17. The values of such signals can be processed and corrected, e.g. on the basis of compensation values or coefficients stored in the device 22, in order to obtain measurement signals the values of which are indicative of the diametral dimensions of the crankpin 18 that is ground. The measurement signals are used by the NC 33 to stop the working of the crankpin 18 when a predetermined diametral dimension is reached.

Afterwards, a checking relevant to the roundness of the crankpin surface is performed. In the roundness checking phase, the interpolated movements of the grinding machine parts (grinding-wheel slide, worktable) are controlled so that, during the orbital movement of the crankpin 18, the grinding-wheel 4 surface moves for keeping a negligible distance from the crankpin surface.

In the roundness checking phase the crankshaft 34 undergoes a 360° rotation, in the course of which the values of the signals outputted by the transducer 41 are detected and (after possible corrections as cited above) stored. Such values are detected at predetermined spaced out angular positions, e.g. every degree, under the control of the rotative transducer 35, to obtain a sequence of "rough" values rg(θ), where θ=0, 1, . . . , 359. The signals of the transducer 41 can be detected in other suitable ways, e.g. through a time scanning at constant rotation speed of the crankshaft 43. The rough values rg(θ) refer to radial dimensions of crankpin 18 at predetermined angular positions θ of such crankpin 18, and include deviations due to some features of the checking apparatus. In particular, the rough values rg(θ) are affected both by reciprocal dynamical oscillations of the gauging head 39 in the course of the orbital movements of the crankpin 18, and by intermodulation of the form deviations of the surface of the crankpin 18 due to contact between the reference device 20 and such surface. The rough values rg(θ) are transmitted to the NC 33 to be processed—as specified in the description that follows—to obtain profile values r(ϕ) indicative of the actual crankpin profile, i.e. of variations of the radial dimensions of the crankpin 18 as a function of the angular position about the geometrical symmetry axis C. The profile values r(ϕ) can be directly used by the NC 33 to detect roundness errors—as can be done by the specific roundness checking apparatuses used in the known art—and to consequently correct the program that controls the working operations.

Figure 4:
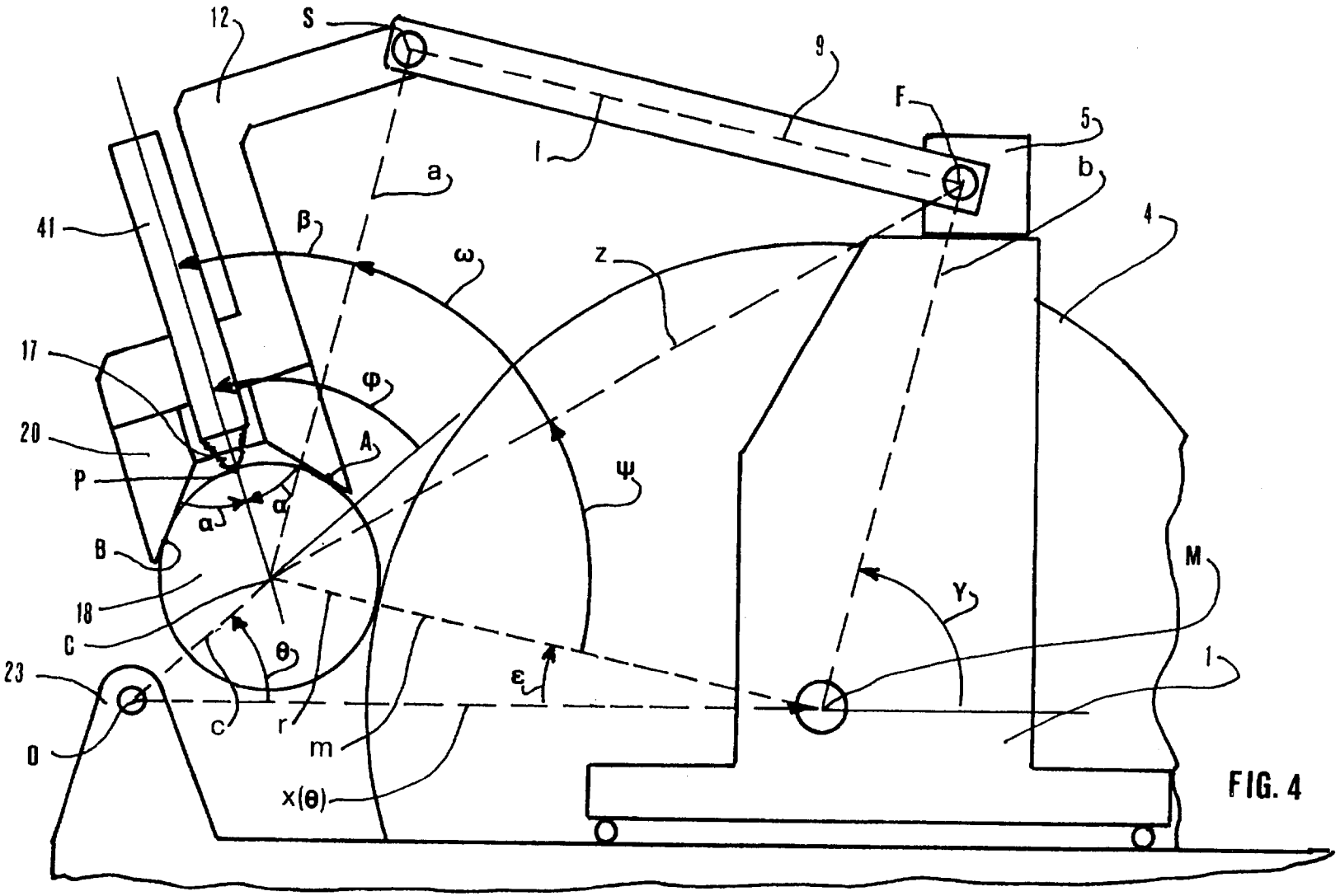
FIG. 4 is a schematic lateral view of an apparatus according to the invention—the dimensions and proportions of which do not exactly correspond to the ones of FIG. 1—during the checking of a crankshaft being ground, FIGS. 5*a*, 5*b*, 5*c* and 5*d* schematically show the cross-section of a pin having an evident form error, and graphic representations of the profile of the pin detected with different apparatuses.
Figure 5C:
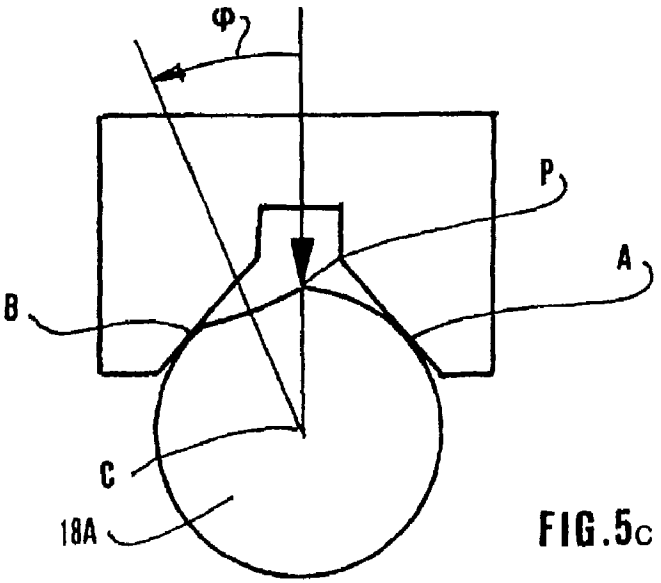
Figure 5D:
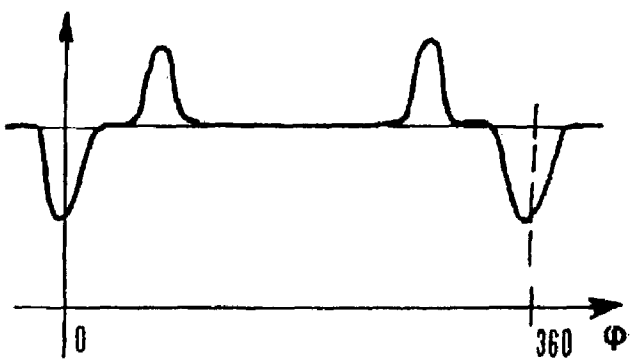
Figure 5A:
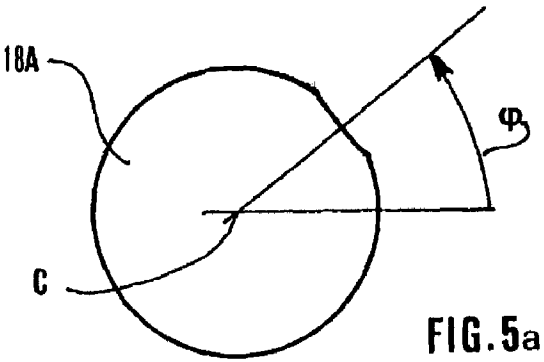
Figure 5B:
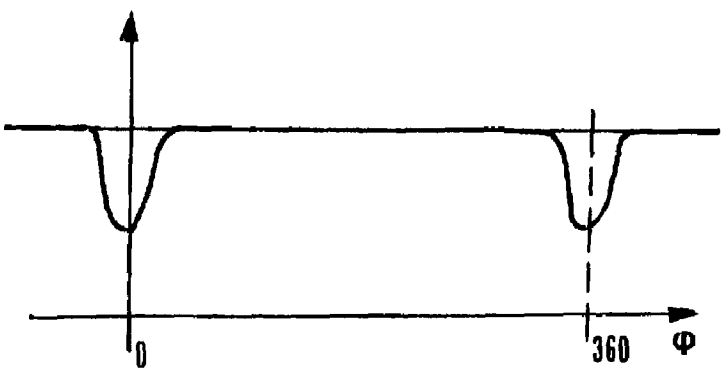

FIG. 4 schematically shows some parts of the apparatus during a roundness checking of crankpin 18. Furthermore, FIG. 4 displays the locations of rotation and geometrical axes, some particular points (such as the contact point P between the feeler 17 and the crankpin surface) and geometrical items, such as distances and angles, that have constant values in a specific application having a determined arrangement:

- α: angle between each side of the Vee of the reference device 20 (or better of its projection on the plane of FIG. 4) and the bisecting line of the Vee;
- c: eccentricity OC of the crankpin 18 (or throw);
- r: nominal value of the crankpin 18 radius;
- m: grinding-wheel 4 radius;
- b: distance between the rotation axes M and F;
- γ: angular arrangement of the straight line on which the distance b lies, or angle between such straight line and the translation direction of the grinding-wheel slide 1;
- l: distance between the rotation axes F and S;
- a: distance between the rotation axis S and the geometrical axis C of crankpin 18;
- β: angular arrangement of the straight line SC with respect to the bisecting line of the Vee-shaped reference device 20 (or angle SCP).

FIG. 4 also displays the following variable items:

- θ: angular arrangement of crankshaft 34 as detected by the rotative transducer 35;
- e: angle between the straight line passing through the axes M of the grinding wheel and C of crankpin 18 and the translation direction of the grinding-wheel slide 1;
- x(θ): distance between axes M (of the grinding-wheel 4) and O (of the crankshaft 34);
- z: distance between geometrical axis C of crankpin 18 and rotation axis F;
- ϕ: angular arrangement of the straight line passing through the axes O of the crankshaft 34 and C of crankpin 18 with respect to the bisecting line of the Vee-shaped reference device 20.

As previously cited, the rough values rg(θ) are affected by errors due to the reciprocal dynamical oscillations of the gauging head 39 on the crankpin surface. In fact, since the crankpin 18 rotates about a rotation axis (O) that is spaced apart of the eccentricity c from its own geometrical symmetry axis (C), during the above-mentioned controlled interpolated movements (according to which a negligible distance is maintained between the grinding-wheel 4 and the crankpin 18 surfaces), symmetry axis C oscillatory moves, with respect to the grinding wheel 4, following an arc of radius MC about axis M of the grinding wheel 4. Owing to kinematic and geometric features of the support device and of the head 39, defining the articulated quadrilateral MFSC, the Vee-shaped reference device 20 engages the crankpin 18 assuming an angular arrangement that, in general terms, varies during the orbital rotation of the crankpin.

As a consequence, there is not a full coincidence between the values of the increments of the angular arrangements θ of the crankshaft 34, as detected by the rotative transducer 35, and consequential increments values of angle ϕ, indicative of the position of the contact point P about symmetry axis C. The effect of the hunting of head 39 on crankpin 18 are alterations, or deviations of the rough values rg(θ) with respect to actual profile values, deviations that differently affect the rough values rg(θ) in different moments of the roundness checking phase. The method according to the present invention includes a first processing of the rough values rg(θ) in order to eliminate the above mentioned deviations due to the reciprocal dynamical oscillations of the gauging head 39 on the crankpin surface.

To this end, the following operations are performed for each value of angle θ comprised between 0° and 359°:

- the value of angle e is calculated by means of well know and simple trigonometric equations in connection with triangle COM, where two legs (OC, CM) and one angle (COM=θ) have known values;
- after having calculated the value of angle CMF (equal to 180°−e−γ), and since two legs (CM, MF) of triangle CMF have known lengths, the values of CF=z and of angle MCF=ψ are obtained by means of well known and simple trigonometric equations;
- having knowledge of the lengths of all three legs of triangle CFS, the value of angle FCS=ω is easily obtained;
- it is finally possible to obtain the value of angle ϕ as ϕ=β+ω+ψ−θ−e.

By repeating, as mentioned above, the operations for each of the 360 values of θ, it is possible to have a correlation function ϕ=ϕ(θ) allowing to correct (or "put in phase") the sequence of rough values rg(θ) by means of well known numerical interpolation techniques, and to obtain a sequence of angularly compensated values rf(ϕ).

It is to be pointed out that the operations to get the correlation ϕ=ϕ(θ) must be performed only once, when the nominal dimensions of crankpin 18 to be checked or the geometric features of the apparatus (support device and head) vary.

As already cited in the present description, the sequence of angularly compensated values rf(ϕ), is still affected by further alterations, due to intermodulations of form deviations of crankpin 18 as a consequence of the fact that the position of the feeler 17 is detected making reference to the Vee-shaped device 20, the latter touching the surface to be checked of the crankpin 18.

In fact, contrary to what happens when measuring the crankpin 18 by means of a known roundness measuring apparatus, where the crankpin is fixed to a turning table precisely rotating about a reference axis (the accuracy of the rotation movement is about ten times better than the manufacturing tolerance), the head 39 includes a reference device 20 having surfaces of a Vee-shaped element resting upon portions of the crankpin 18 surface (indicated with points A and B in FIG. 4) that are affected by form deviation errors. This causes a rather complex modulation of the form deviation errors in the contact points A, B and P on the measuring signal provided by the transducer 41, that depends on the value of angle a between a side of the Vee and the straight line along which the feeler 17 moves, and on the harmonic order of the error. FIGS. 5*a* to 5*d* schematically illustrate the above-mentioned feature by showing a pin 18A (FIG. 5*a*) having a localized form error. A prior art roundness measuring apparatus can properly detect the error, that is revealed by the gauge once in a 360° turn. The output signal has the trend schematically shown in FIG. 5*b*. The same pin 18A checked by means of the head 39 (FIG. 5*c*) gives rise to a more complex output signal (FIG. 5*d*) showing three irregularities in the 360° turn. In fact, in the latter case the (single) error is "detected" not only when the feeler 17 (point P) gets in touch with the corresponding surface area, but also—and with opposite sign—when such area is touched by the points A and B of the sides of the Vee-shaped device 20.

According to the method of the present invention, the negative effects of the above-mentioned intermodulations of the form deviation errors of the crankpin 18 surface are compensated by performing a harmonic analysis of the angularly compensated values rf(ϕ).

Any periodic function, such as the detection of the pin profile according to the present invention, can be expressed as a Fourier series:

$$f(\theta) = A_0 + \sum_i A_i \cdot \cos(i \cdot \theta) + B_i \cdot \sin(i \cdot \theta)$$

where the $A_i$, $B_i$ represent the Cartesian projections X, Y of the $i^{th}$ harmonic component having amplitude $C_i$ and phase $\phi_i$:

$$C_i = \sqrt{A_i^2 + B_i^2}$$

$$\Phi_i = \arctan\frac{B_i}{A_i}$$

In order to describe with sufficient approximation the profile of crankpin 18, it can be enough to calculate the first ten/fifteen harmonics, since further harmonics can give information about vary small surface imperfections, that cannot be defined as roundness errors, but give hints about roughness. It is pointed out that the harmonic analysis keeps separate but different harmonic components relevant to the form error, e.g. an ovality error (second harmonic) can be revealed only in its projections $A_2$, $B_2$, and in no harmonics of any other orders. It is possible to use this feature of the harmonic analysis to compensate for the harmonic modulation caused by the Vee-shaped reference device 20 of the head 39. In fact, each harmonic component is subject to an amplitude modulation and a phase displacement that only depend on the value of angle α between a side of the Vee and the straight line along which the feeler 17 moves, and on the harmonic order. As an example, the harmonic analysis relative to a Vee defining a symmetric angle of 80° (α=40°) gives rise to the compensation coefficients listed in the following table:

| Order of the harmonic i | Magnification coefficient $K_i$ | Phase difference $\sigma_i$ |
|---|---|---|
| 2 | 1.270 | 180° |
| 3 | 2.347 | 180° |
| 4 | 2.462 | 180° |
| 5 | 1.532 | 180° |
| 6 | 0.222 | 180° |
| 7 | 0.532 | 0° |
| 8 | 0.192 | 0° |
| 9 | 1.000 | 180° |
| 10 | 2.192 | 180° |
| 11 | 2.532 | 180° |
| 12 | 1.778 | 180° |
| 13 | 0.468 | 180° |
| 14 | 0.462 | 0° |
| 15 | 0.347 | 0° |

It is pointed out that angle α shall be chosen in such a way that the magnification coefficients $K_i$ not be too much smaller than 1 (and in particular they shall not be null), at least as far as the harmonics of the actually interesting orders are involved.

After having calculated—once and for all for a given angle α—the values of the above table, it is possible to use the compensated values to obtain the "actual" profile of crankpin 18, i.e. the profile that is obtainable by means of the previously cited prior art roundness checking apparatuses.

To do so, the amplitude values $C_i$ of the harmonic analysis must be divided by the corresponding magnification coefficient $K_i$, and the phase difference $\sigma_i$ must be added to phase $\phi_i$.

In substance, the method for the determination of the profile of the crankpin 18—in order to check its roundness—includes the following phases:

- acquisition of a sequence of rough values rg(θ) from the signals outputted by the transducer 41 in the course of a 360° rotation of the crankshaft 34,
- calculation of the correlation $\phi=\phi(\theta)$,
- hunting compensation of the rough values rg(θ) based on the correlation $\phi=\phi(\theta)$, to compensate for errors due to the reciprocal dynamical oscillations of the gauging head 39 on the crankpin surface,
- setting up of a sensitivity and phase difference table relevant to harmonics of orders 1–n (e.g. 1–15) depending on angle α between a side of the Vee of the reference device 20 and the straight line along which the feeler 17 moves,
- harmonic analysis of the "apparent" profile (angularly compensated values rf(ϕ) and calculations of the amplitude and phase values of the n harmonics,
- compensation of the amplitude values by means of the magnification coefficients $K_i$,
- phase adjustment of each harmonic by the values $\sigma_i$,
- obtainment of the "actual" profile r(ϕ) through synthesis of the n harmonics by means of the Fourier formula.

It is pointed out that some of the above-listed phases must not be repeated in case that the geometry of the apparatus and the nominal dimensions of the crankpin 18 do not change.

As a result, the "actual" profile r(ϕ) of crankpin 18 is obtained, and can be further processed, graphically represented (plotted), or used in other known ways.

Figure 6:
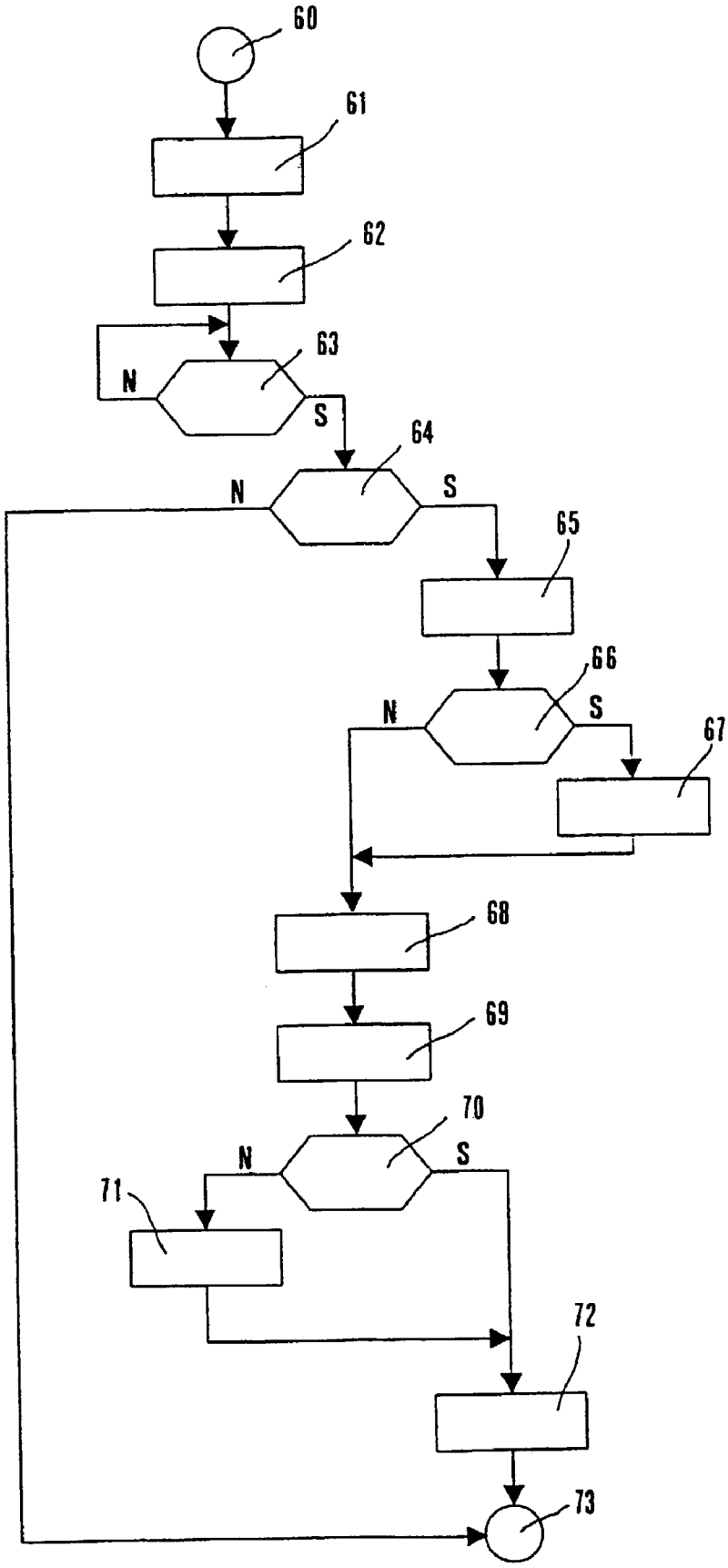
FIG. 6 is a flow chart showing the sequence of steps of a method according to the present invention, for the dimensional and form deviation checking of a crankpin.

The flow chart of FIG. 6 reports the steps of a working cycle including in-process dimensional checking and shape checking of an orbitally moving crankpin 18, according to the method of the present invention.

The blocks of the flow chart have the following meaning:

60—start

61—the crankshaft 34 is positioned and connected to the worktable 23 and rotated about axis O, and the NC

33—controls movements of the grinding-wheel slide 1;

62—under the control of the NC 33, the double-acting cylinder 28 is activated to bring the head 39 to the checking condition, i.e. to bring the Vee-shaped reference device 20 into engagement with the crankpin 18 surface during the orbital motion of the latter;

63—the working of the crankpin 18 is performed until a proper measuring signal relevant to the diametral dimensions of the crankpin 18 is provided by the transducer 41 and detected by NC 33;

64—in case that the roundness checking is not required, the cycle ends (block 73);

65—rough values rg(θ) are stored during a further orbital rotation of the crankpin 18;

66—it is checked whether a new correlation function $\phi=\phi(\theta)$ must be calculated, e.g. in case it has never been calculated or if the geometrical features of the grinding machine and of the checking apparatus, and/or the nominal dimensions of the crankpin were changed;

67—a (new) correlation function $\phi=\phi(\theta)$ is calculated;

68—the rough values rg(θ) are compensated based on the correlation function $\phi=\phi(\theta)$ to obtain angularly compensated values rf(ϕ) relevant to an "apparent" profile rf(ϕ) of the crankpin 18;

69—the harmonic analysis of the "apparent" profile rf(ϕ) is performed, and amplitudes ($C_i$) and phase ($\phi_i$) values of the n harmonics are calculated;

70—it is checked whether a proper table of sensitivity and phase difference values in connection with the particular Vee-shaped device 20 and relevant angle α is available;

71—a (new) table of sensitivity and phase difference values is obtained;

72—the values of the amplitudes and phases of the n harmonics are corrected on the basis of the contents of the table, and the actual profile r(ϕ) of the crankpin 18 is obtained;

73—the cycle ends.

It is pointed out that the flow chart of FIG. 6 does not include the subsequent phase of correction of the working program stored in the NC 33 on the basis of the errors, as they are detected during the roundness checking phase, affecting the crankpin 18 surface. Such correction can be implemented in different known ways.

It is pointed out what follows. In case that the dimensions and mutual arrangement of the grinding machine, the checking apparatus and the crankshaft are chosen so that, making reference to FIG. 4, a=b and l=(m+r), the consequent "parallelogram like" movements of the coupling elements 9 and 12 of the support device do not cause reciprocal dynamical oscillations of the gauging head 39 on the crankpin 18 surface. As a consequence, steps 66 to 68 of the method according to FIG. 6 can be omitted. However, it is to be noted that just slight variations of the nominal diametral dimensions of the crankpin 18 with respect to the above described configuration cause reciprocal dynamic oscillations, and consequent alteration of the values detected by the head 39. As a consequence, performing the steps 66 to 68 is in general important and advantageous.

Figure 7:
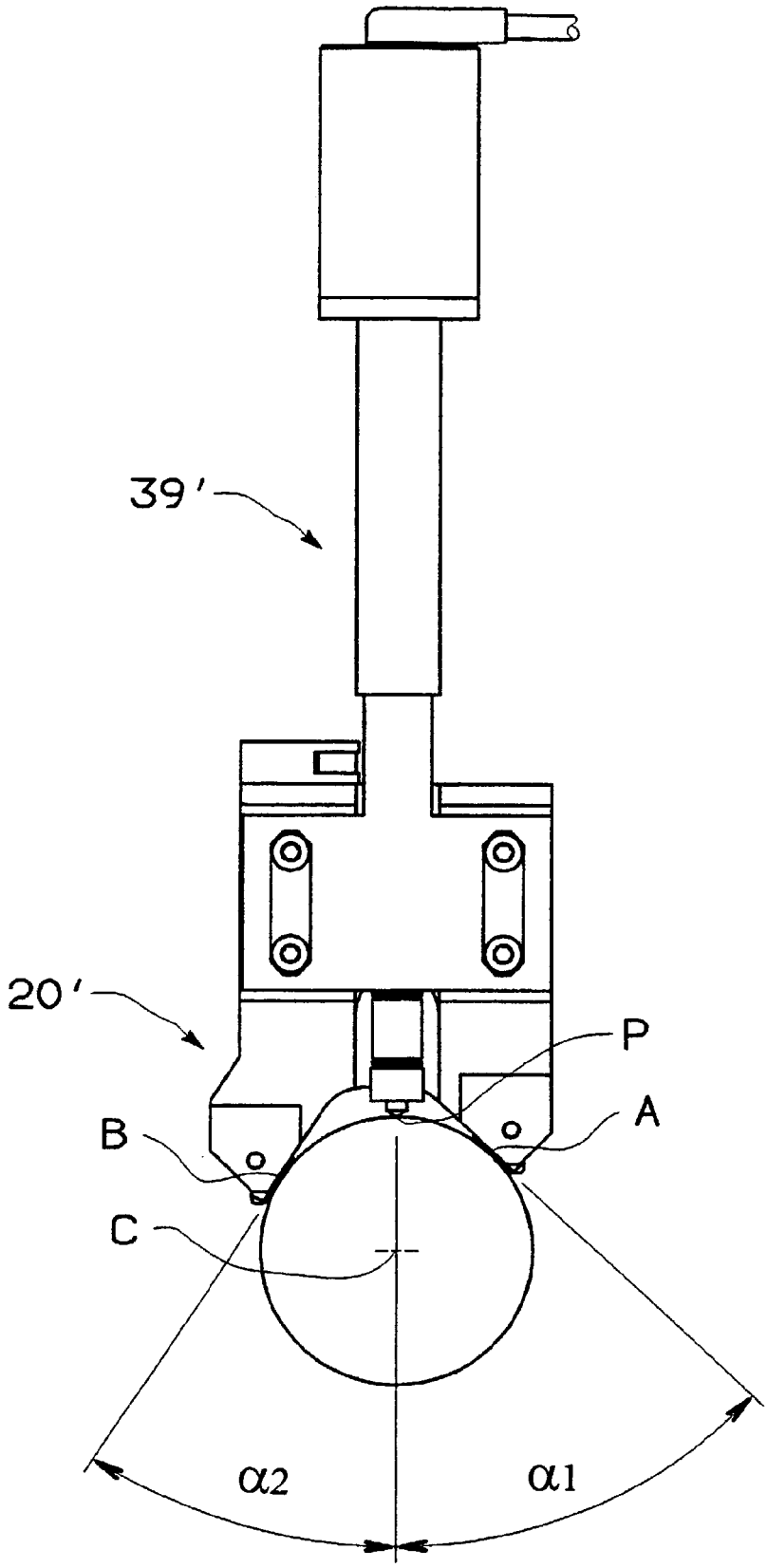
FIG. 7 is a view of a measuring device of an apparatus of the present invention, according to an embodiment different from the one shown in FIG. 3.

The checking apparatus according to the present invention can include a Vee-shaped reference device 20' having a Vee surface asymmetric with respect to the translation direction of feeler 17. A gauging head 39' including the device 20' is shown in FIG. 7, where references A, B, C and P indicate the same points referred to in FIGS. 4 and 5*c*. In the example of FIG. 7, the overall angle comprised between the sides of the Vee surface of device 20' is equal to angle 2α=80° of the symmetric device 20. However, the Vee surface is rotated 7° with respect to the translation direction of feeler 17, in other words the bisecting line of the Vee is angularly arranged with respect to said translation direction, so that angles APC and BPC between each side of the Vee (or better of its projection on the plane of FIG. 7) and such translation direction are no more equal to each other (α=40°) but have different values, in particular, APC=α1=47° and BPC=α2=33°.

By employing the asymmetric device 20' it is possible to improve the accuracy of the roundness checking, by increasing the sensitivity of the apparatus to errors corresponding to harmonic in a range of orders that is wider than the range that can be covered by means of the gauging head 39. In fact, the compensation table corresponding to reference device 20' is as follows:

| Order of the harmonic i | Magnification coefficient $K_i$ | Phase difference $\sigma_i$ |
|---|---|---|
| 2 | 1.241 | 170° |
| 3 | 2.288 | 166° |
| 4 | 2.392 | 165° |
| 5 | 1.529 | 173° |
| 6 | 0.807 | −130° |
| 7 | 1.166 | −91° |
| 8 | 0.958 | −105° |
| 9 | 0.861 | 175° |
| 10 | 1.739 | 139° |
| 11 | 2.013 | 133° |
| 12 | 1.432 | 148° |
| 13 | 1.272 | −156° |
| 14 | 1.902 | −131° |
| 15 | 1.825 | −134° |

By comparing the contents of the tables relevant to reference devices 20 and 20', it is evident that the values of the magnification coefficients $K_i$ are far better in the latter case. In fact, as far as the order range 2–15 is concerned, in the latter case just three out of fourteen coefficients have value lower than 1 (in the former case only eight coefficients reached such value). Moreover, the lower value of $K_i$ with the asymmetric device 20' is not so far from 1 (i.e. 0,807), and is greater than six of the fourteen coefficients relevant to the symmetric device 20 (in the "symmetric case" the lower value is 0,192).

It is to be noted that the particular roundness checking cycle, involving the mutual movements of the grinding-wheel slide and worktable substantially simulating a working cycle (but without contact taking place between the grinding wheel and the crankpin to be checked) is particularly advantageous. In fact, in such a cycle the support device undergoes limited displacements, limiting in such a way the reciprocal dynamical oscillations of the gauging head 39 (or 39') on the crankpin surface. In this way, the deviations that such oscillation causes in the rough values rg(θ) are reduced, and it results easier to compensate for such deviations with a method according to the present invention. Moreover, the layout of the same support device can be compact, since wide movements of the gauging head 39 (or 39') to follow the crankpin 18 are not required.

By means of a checking apparatus and method according to the invention it is possible to accurately perform in-process dimensional checking of the crankpin 18 as well as roundness checking of the same crankpin 18 in a particularly simple and quick way, without the need of additional costly metrological devices.

Apparatuses according to the present invention can include features differing from what is described above and shown in the drawings. As an example, the components of the support device can have different shape and/or arrangement, and, at least one of them, can be translatable and not rotatable. Other possible differences can involve the guide device 21, that can be omitted or replaced by a different device, having guiding surfaces touching portions of the connecting elements (9 or 12) or other parts of the apparatus, instead of touching the crankpin 18 surface.

Moreover, the support device can be connected to a different part of the grinding machine, e.g. to a basement or to another part fixed with respect to the grinding-wheel slide.

The sampling frequency in the acquisition phase of the rough values rg(θ) can be different with respect to what is described above, and the activities of the processing and display device 22 can be performed by any processing means having the proper features, e.g. by a commercially available personal computer.

The invention claimed is:

1. An apparatus for dimensional and form deviation checking of a crankpin of a crankshaft during orbital rotations about a main rotation axis on a numerical control grinding machine, the grinding machine having a grinding-wheel slide carrying a grinding wheel and a worktable defining said main rotation axis, said apparatus comprising:

a gauging head with a Vee-shaped reference device adapted to engage the crankpin to be checked, a single movable feeler adapted to touch a surface of the crankpin to be checked, and a transducer adapted to provide signals indicative of the position of the single movable feeler with respect to the Vee-shaped reference device;

a support device, with mutually movable coupling elements, that movably supports the gauging head;

an angular detection unit for detecting an angular position of the crankshaft;

a control device to control automatic displacements of the gauging head from a rest position to a checking position, and vice-versa; and processing and display devices, connected to the gauging head, adapted to receive and process said signals provided by the transducer to obtain values indicative of the profile of the crankpin to be checked, wherein said processing and display devices are further connected to the angular detection unit and are adapted to obtain and store values corresponding to the signals provided by the transducer at predetermined spaced out angular positions during the rotation of the crankshaft, and to compensate the values of the signals provided by the transducer for alterations caused both by the movements of the coupling elements and the gauging head as the gauging head follows the crankpin in its orbital rotations in the checking condition, and by the contact between the Vee-shaped reference device and the surface of the crankpin to be checked, the processing and display devices being adapted to compensate for alterations caused by said movements of the coupling elements and the gauging head at least on the basis of geometric features of the support device.

2. The apparatus according to claim 1, wherein said support device includes a support element, a first coupling element coupled to the support element, said first coupling element being rotatable about a rotation axis parallel to said main rotation axis, and a second coupling element carrying the gauging head and coupled to the first coupling element, said second coupling element being rotatable about another rotation axis parallel to said main rotation axis.

3. The apparatus according to claim 1, wherein the support device is coupled to the grinding-wheel slide.

4. The apparatus according to claim 1, wherein the gauging head includes a guide casing fixed to the support device and a transmission rod axially movable within the guide casing, the single movable feeler being fixed to one end of said transmission rod, the transducer having a movable element connected to the opposite end of the transmission rod.

5. The apparatus according to claim 1, wherein in said checking condition of the head the Vee-shaped reference device is adapted for maintaining contact with the crankpin to be checked substantially due to the force of gravity.

6. The apparatus according to claim 1, further including a guide device for guiding the arrangement of the Vee-shaped reference device on the crankpin in the course of the orbital motion of the crankpin.

7. The apparatus according to claim 1, wherein the processing and display devices are adapted to obtain and store a sequence of rough values corresponding to the signals provided by the transducer at predetermined spaced out angular positions during the rotation of the crankshaft and to process said sequence to provide profile values indicative of the crankpin profile.

8. The apparatus according to claim 1, wherein the value of the angle between the Vee sides of the Vee-shaped reference device is about 80°.

9. The apparatus according to claim 1, wherein the single movable feeler of the gauging head can move along a translation direction corresponding to a bisecting line of the Vee-shaped reference device.

10. The apparatus according to claim 1, wherein the single movable feeler of the gauging head can move along a translation direction, and wherein a bisecting line of the Vee-shaped reference device is angularly arranged with respect to said translation direction.

11. The apparatus according to claim 10, wherein two angles formed between Vee sides of the Vee-shaped reference device and said translation direction of the single movable feeler are different from each other by at least 10°.

12. The apparatus according to claim 10, wherein an angle formed between the bisecting line of the Vee-shaped reference device and said translation direction of the single movable feeler is about 70°.

13. A method for checking form deviation of a pin defining a geometrical symmetry axis, the pin orbitally moving about a main rotation axis, in a numerical control grinding machine including a grinding-wheel slide carrying a grinding-wheel, a worktable defining said main rotation axis, an angular detection unit adapted to detect angular position of the pin about the main rotation axis and provide relevant signals, and a checking apparatus including a gauging head movably connected to the grinding machine and having a Vee-shaped reference device adapted to cooperate with the pin to be checked, a single movable feeler adapted to touch a surface of the pin to be checked and to move along a translation direction, and a transducer adapted to provide a processing device with signals indicative of the position of the single movable feeler with respect to the Vee-shaped reference device, the method comprising the steps of:

detecting and storing a sequence of rough values corresponding to the signals provided by the transducer at predetermined angular positions of the pin; and processing said sequence of rough values to obtain profile values indicative of the deviations of radial dimensions of the pin at corresponding sections of the surface of the pin angularly spaced out around the symmetry axis, the processing step including:

compensating components affecting the rough values due to contact between the Vee-shaped reference device and the pin surface, and amending the rough values to obtain a sequence of angularly compensated values at said corresponding sections by compensating, at least on the basis of geometric features and dimensions of the checking apparatus, the grinding machine and the pin to be checked, variations in the angular arrangement of the Vee-shaped reference device and of said translation direction of the single movable feeler raking place as the gauging head follows the pin in its orbital rotations about said main rotation axis.

14. The method according to claim 13, wherein said processing step comprises:

performing harmonic analysis of a sequence of values relevant to the radial dimensions of the pin at said sections of the surface of the pin angularly spaced out around the symmetry axis, and calculating the values of amplitudes and phases of the harmonics;

correcting the values of said amplitudes and phases on the basis of compensation coefficients relevant to angles defined by the Vee sides of the Vee-shaped reference device and the translation direction of the single movable feeler; and obtaining said profile values by means of the harmonics with the corrected values of amplitudes and phases.

15. The method according to claim 14, wherein the processing step further includes calculating said compensation coefficients on the basis of said angles defined by the Vee sides of the Vee-shaped reference device and the translation direction of the single movable feeler.

16. The method according to claim 14, wherein said harmonic analysis is performed on the sequence of angularly compensated values.

17. The method according to claim 16, wherein the processing step further includes calculating a correlation function on the basis of said geometric features and dimensions of the checking apparatus, of the grinding machine and of the pin to be checked, the correlation function being used for said amending the rough values to obtain a sequence of angularly compensated values.

18. The method according to claim 13, wherein said gauging head is also adapted to perform dimensional checking of the diametral dimensions of the pin during its processing on the grinding machine.

19. The method according to claim 13, wherein said pin is a crankpin of a crankshaft, the method further including the step of in-process checking diametral dimensions of the crankpin by means of the checking apparatus, and said step of detecting and storing the sequence of rough values being performed:

after the processing of the crankpin is stopped on the basis of the signals provided by the checking apparatus; and during movements of the grinding-wheel slide and/or worktable such that, under the control of the numerical control of the machine, the crankpin accomplishes an orbital movement and the surface of the grinding-wheel is kept at a negligible distance from the crankpin surface.

20. An apparatus for dimensional and form deviation checking of a crankpin during orbital rotation, said apparatus comprising:

a gauging head with a Vee-shaped reference device adapted to engage a crankpin to be checked, a single movable feeler, movable along a translation direction and adapted to touch a surface of the crankpin to be checked, said translation direction being not coincident with a bisecting line of the Vee-shaped reference device, and a transducer adapted to provide signals indicative of the position of the single movable feeler with respect to the Vee-shaped reference device;

a support device, with mutually rotatable coupling elements, that movably supports the gauging head; and processing and display devices, connected to the gauging head, adapted to receive and process said signals provided by the transducer, wherein said processing and display devices process signals provided by the transducer to obtain values indicative of the profile of the crankpin to be checked, said processing and display devices being adapted to compensate the values of the signals provided by the transducer for alterations caused by rotations of the coupling elements and the gauging head as the gauging head follows the crankpin in its orbital rotation during a checking condition, and by the contact between the Vee-shaped reference device and the surface of the crankpin to be checked.

21. The apparatus according to claim 20, wherein two angles formed between the Vee sides of the Vee-shaped reference device and said translation direction of the single movable feeler are different from each other by at least 100.

22. An apparatus for dimensional and form deviation checking of a crankpin of a crankshaft during orbital rotation, said apparatus comprising:

a gauging head with a Vee-shaped reference device adapted to engage a crankpin to be checked, a single movable feeler, movable along a translation direction and adapted to touch a surface of the crankpin to be checked, said translation direction being not coincident with a bisecting line of the Vee-shaped reference device, and a transducer adapted to provide signals indicative of the position of the single movable feeler with respect to the Vee-shaped reference device;

a support device, with mutually rotatable coupling elements, that movably supports the gauging head;

an angular detection unit for detecting an angular position of the crankshaft; and processing and display devices, connected to the gauging head, adapted to receive and process said signals provided by the transducer, wherein said processing and display devices process signals provided by the transducer to obtain values indicative of the profile of the crankpin to be checked, said processing and display devices are further connected to the angular detection unit and are adapted to obtain and store values corresponding to the signals provided by the transducer at predetermined spaced out angular positions during the rotation of the crankshaft, and to compensate the values of the signals provided by the transducer for alterations caused by rotations of the coupling elements and the gauging head as the gauging head follows the crankpin in its orbital rotation during a checking condition, and by the contact between the Vee-shaped reference device and the surface of the crankpin to be checked.

* * * * *

UNITED STATES PATENT AND TRADEMARK OFFICE

CERTIFICATE OF CORRECTION

PATENT NO. : 7,047,658 B2 
APPLICATION NO. : 10/220320
DATED : May 23, 2006
INVENTOR(S) : Franco Danielli et al.

It is certified that error appears in the above-identified patent and that said Letters Patent is hereby corrected as shown below:

In the Title Page:

In Item (73): "Marposs Societa per Azioni" should read --Marposs Società per Azioni--;

In the Abstract: Item (57)

In line 8 of the Abstract: "guaging" should read --gauging--;

In the Specification:

Column 6, line 22: "1" should read --I--;

Column 6, line 31: "e" should read --ε--;

Column 7, line 7: "e" should read --ε--;

Column 7, line 12: "e" should read --ε--;

Column 7, line 20: "e" should read --ε--;

Column 7, line 51: "angle a" should read --angle α--;

Column 8, line 13: after "where the" please insert --coefficients-- ;

Column 8, line 16: "$\overline{C_i=Ai^2+Bi^2}$" should read -- $C_i=\sqrt{Ai^2+Bi^2}$ --;

Column 8, line 29: "but" should read --the--;

Column 9, line 25: "rf(φ)" should read --rf(φ))--;

Column 9, lines 47 -48: the term "33-controls" should follow the term "NC" and not be carried over to the next line, and the dash between "33" and "controls" should be deleted;

Column 10, line 31: "1" should be --I--;

UNITED STATES PATENT AND TRADEMARK OFFICE

CERTIFICATE OF CORRECTION

PATENT NO. : 7,047,658 B2
APPLICATION NO. : 10/220320
DATED : May 23, 2006
INVENTOR(S) : Franco Danielli et al.

It is certified that error appears in the above-identified patent and that said Letters Patent is hereby corrected as shown below:

<u>In the Claims</u>:

Claim 12, Column 13, line 32: "70°" should read --7°--; and

Claim 21, Column 15, line 20: "l00" should read --10°--.

Signed and Sealed this

Twentieth Day of March, 2007

JON W. DUDAS
*Director of the United States Patent and Trademark Office*